US005238197A

United States Patent [19]

Leins

[11] Patent Number: 5,238,197

[45] Date of Patent: Aug. 24, 1993

[54] BOBBIN-WINDING

[75] Inventor: Eberhard Leins, Heiningen, Fed. Rep. of Germany

[73] Assignee: Scheller GmbH & Co. KG, Eislingen, Fed. Rep. of Germany

[21] Appl. No.: 943,744

[22] Filed: Sep. 11, 1992

[30] Foreign Application Priority Data

Sep. 13, 1991 [DE] Fed. Rep. of Germany ..... 4130464

[51] Int. Cl.[5] ..... B65H 67/048

[52] U.S. Cl. ..... 242/18 A; 242/18 R

[58] Field of Search ..... 242/18 A, 25 A, 18 R, 242/18 PW, 56 A

[56] References Cited

U.S. PATENT DOCUMENTS

| | | | |
|---|---|---|---|
| 1,912,250 | 5/1933 | Borletti | 242/18 A X |
| 2,120,944 | 6/1938 | Sedgley | 242/18 A X |
| 2,177,311 | 10/1939 | Weimer | 242/18 A |
| 2,266,121 | 12/1941 | Kinsella et al. | 242/18 A X |
| 2,772,054 | 11/1956 | Herele et al. | 242/18 A |
| 3,583,650 | 6/1971 | Zaborovsky | 242/18 A X |
| 3,604,642 | 9/1971 | Hirst et al. | 242/18 A |
| 3,695,521 | 10/1972 | Torii et al. | 242/18 A |
| 4,029,266 | 6/1977 | Mori et al. | 242/20 |
| 4,299,357 | 11/1981 | Munker | 242/18 DD |

FOREIGN PATENT DOCUMENTS

| | | |
|---|---|---|
| 243309 | 2/1912 | Fed. Rep. of Germany . |
| 3810875AI | 10/1989 | Fed. Rep. of Germany . |

*Primary Examiner*—Stanley N. Gilreath
*Attorney, Agent, or Firm*—Chilton, Alix & Van Kirk

[57] ABSTRACT

The winding heads of a bobbin-winding machine are provided with automatic bobbin exchange capability through the use of an indexable magazine which carries multiple interchangeable spindle units. The spindle units engage bobbins and, in turn, are adapted to be engaged by a rotary drive mounted on a transfer arm. The transfer arm moves individual spindle/bobbin combinations between the magazine and the bobbin-winding position after engagement with the rotary drive. Disengagement of a spindle/bobbin combination after winding and return to the magazine permits automatic exchange with a spindle carrying an empty bobbin.

20 Claims, 3 Drawing Sheets

BOBBIN-WINDING

BACKGROUND OF THE INVENTION

1. Field of the Invention

The present invention relates to bobbin-winding machines and particularly to machines of such character wherein empty bobbins are automatically delivered to the winding head and full bobbins may be automatically removed from the winding head. More specifically, this invention is directed to the winding of sewing thread on bobbins and especially to the automatic and serial supply of empty bobbins to a bobbin-winding head and to the subsequent removal therefrom of wound bobbins. Accordingly, the general objects of the present invention are to provide novel and improved apparatus and methods of such character.

2. Description of the Prior Art

In the winding of sewing thread bobbins, it is conventional practice to manually place the empty bobbins, also known as bobbin tubes, on the winding head. Likewise, it is conventional practice to manually remove the bobbins from the winding head after they have been filled, i.e., wound with the desired quantity of thread. Such manual operation has the advantage of imparting flexibility to the winding operation. By way of example, the manual supply of bobbin tubes to the winding head makes small-batch production feasible. However, such manual operation also presents the disadvantage that, when the manufacturing operation has a large number of individually operated winding heads, periods of inactivity inherently result after a bobbin has been fully wound and the head is waiting operator attention. Such "wait" times, when the heads are inactive, diminishes overall plant efficiency.

Bobbin-winding machines are known in the art wherein the supply of empty bobbins to the winding heads is effected automatically and full bobbins are automatically removed from the winding heads. While bobbin-winding machines having automatic bobbin supply and removal capability theoretically exhibit higher productivity than machines wherein such operations are performed manually, experience has shown that such automatic machines are economically justifiable only when batch sizes are comparatively large. Experience has also shown that the previously available automatic bobbin supply and removal devices have been lacking in the requisite reliability and bobbin supply or removal device failure has resulted in disabling the entire winding-head capacity of the production line. A further disadvantage of the prior automatic bobbin supply and removal devices has resided in the fact that such devices have been inconvenient to use. For example, the operating controls of prior art bobbin supply and removal devices have been located at the front of the apparatus while the removal of full bobbins has been effected at the rear of the apparatus.

SUMMARY OF THE INVENTION

The present invention overcomes the above-briefly described and other deficiencies and disadvantages of the prior art and, in so doing, provides a highly efficient technique for delivering bobbins to bobbin-winding heads and for removing full bobbins from such heads. The present invention also encompasses apparatus which, while retaining the advantages of bobbin-winding machines wherein the bobbins are manually inserted on and removed from the winding heads, substantially eliminates the wait times which occur in prior manual machines during periods when the winding head is waiting for an empty bobbin to be supplied thereto.

Apparatus in accordance with a preferred embodiment of the invention is particularly well suited for use with a bobbin winding machine which includes a large number of individual bobbin-winding units. The apparatus of the invention utilizes, for each winding unit, a plurality of interchangable winding spindles. Each winding spindle includes a device for internally engaging a bobbin. The spindles are individually and serially mountable on a transfer arm that can be swung between a bobbin winding position and a bobbin exchange position. The apparatus additionally includes an indexable magazine. The magazine is provided with plural recesses or seats for receiving the interchangeable spindles with bobbins mounted thereon. Means is provided for selectively capturing the winding spindle/bobbin combinations in the seats.

The interchangeable winding spindles of apparatus in accordance with the invention are configured for coupling to a rotary drive carried by the transfer arm. The seats in the magazine are brought, in succession, into an exchange position where they are coaxial with the rotary drive on the transfer arm. A coupling mechanism is then actuated to establish a rotatable drive connection between the spindle and the rotary drive.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
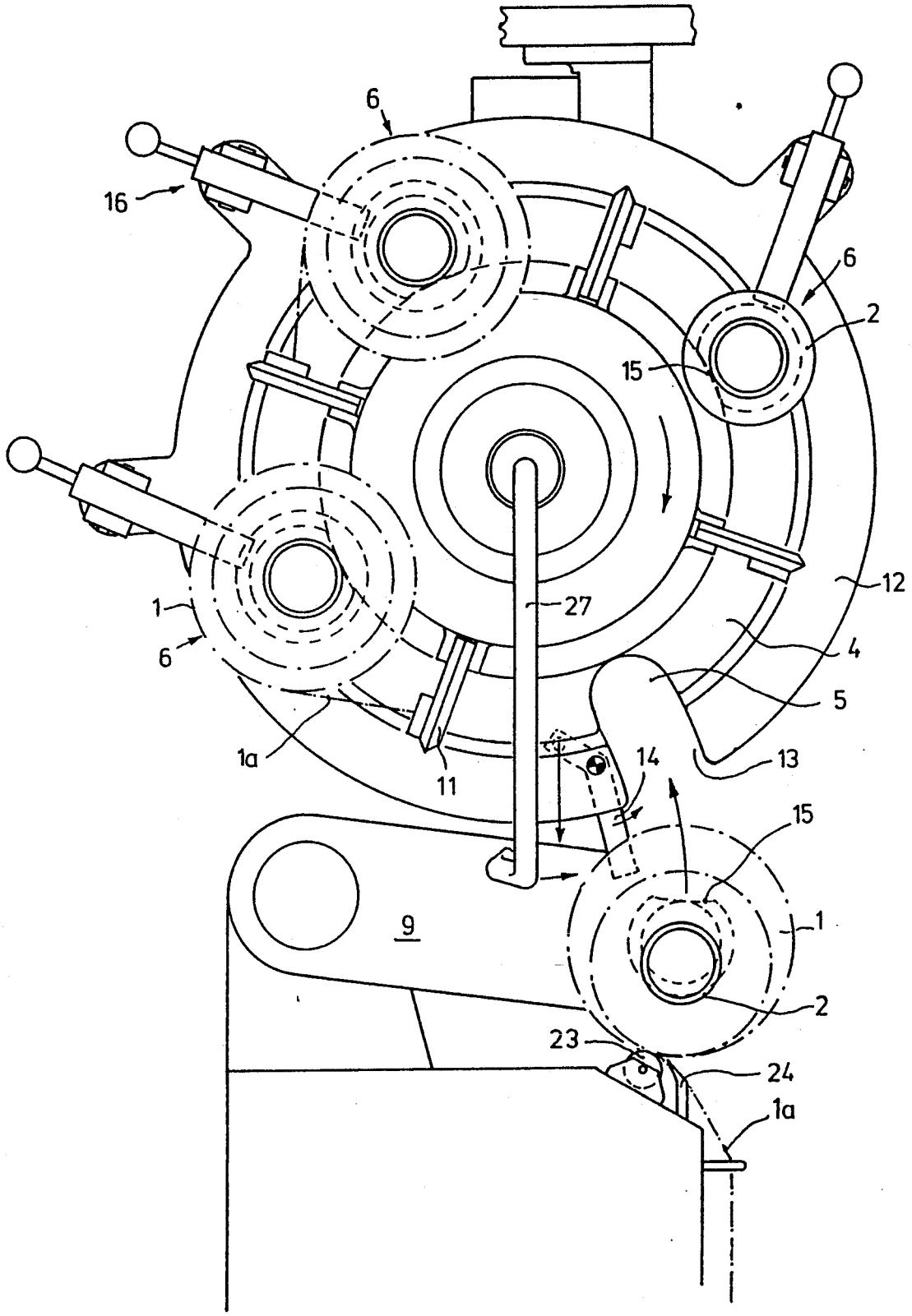
FIG. 1 is a front elevational view of a bobbin-winding unit in accordance with the present invention, FIG. 1 depicting the change magazine in position to receive a fully wound bobbin.

In a typical textile plant, each bobbin-winding machine will be provided with a comparatively large number of individual bobbin-winding units. These bobbin-winding units will customarily be linearly arranged A winding head, which includes a winding roller and a thread guide, will be associated with each bobbin-winding unit. In accordance with the invention, a change magazine is located above each bobbin-winding unit. In considering the description to follow, it should be born in mind that the showings of FIGS. 1 and 2 do not take into account the inclination of the bobbin change magazine. The bobbin change magazines are each equipped with a plurality of winding spindles which may be coupled to a rotary drive. Each of these interchangeable winding spindles carries a chuck for engaging a bobbin. The spindles are individually mountable on and removable from a transfer arm which can be moved between a bobbin-winding position and a bobbin exchange position.

Each change magazine of the disclosed embodiment of the invention comprises a rotatable plate 4. The plate 4 is provided with U-shaped receivers or seats 5 which are designed to carry the interchangeable winding spindles such as indicated generally at 6. The seats 5, which define the index positions of plate 4, open outwardly toward the edge of the plate and are equally spaced. Rotatable plate 4 can be stepped or indexed in increments corresponding to the spacing between seats 5 by means of cams, push-rods, a rack and pinion drive, a motor, a Geneva mechanism or through the agency of other conventional drive means. This indexing may be accomplished under the control of a program.

The winding spindles 6 are, as noted above, interchangeable elements. As may best be seen from FIG. 3, each of the spindles 6 comprises a tubular bearing sleeve 8, a spindle shaft 6*a* and a bobbin engagement means. In the disclosed embodiment, the engagement means is a chuck 3 mounted on shaft 6*a*.

The transfer of an individual spindle 6 into and out of a magazine seat 5 is effected by a moveable transfer arm 9. Arm 9 thus functions as a spindle carrier which may be moved between the bobbin winding position shown in FIG. 1 and the exchange position shown in FIG. 2. The arm 9 is provided with a driven adaptor shaft 10. In the manner to be described below, the spindle shaft 6*a* will be coupled to or decoupled from the driven adaptor shaft 10.

In the practice of the invention, empty tubular bobbins 2 are fitted onto the winding spindles 6 and engaged by the chucks 3. The spindle/empty bobbin combinations are then placed in empty seats in plate 4. When a bobbin on one to the spindle/bobbin combinations has been fully wound, in the manner to be described below, the change magazine will cause exchange of the spindle which is carrying the full bobbin with a spindle which is mated to a empty bobbin. The operation in which the thread is cut and winding is restarted takes place automatically and will also be described below. The invention permits the bobbin-winding unit to run substantially continuously with minimum wait times during automatic spindle exchange. This increases the length of the time intervals between required machine operator attendance to each winding head.

Means are provided for retaining the spindle/bobbin combinations 6 in the seats 5 provided in the rotatable plate 4 of the magazine except at the spindle change position. In the disclosed embodiment, a discontinuous drum-like member 12 performs this retention function. The drum 12 is coaxial and stationary with respect to the plate 4 and defines a cover for the U-shaped seats 5 which are not located at the exchange position. The exchange position is defined by an insertion aperture 13 in drum 12. When located in a seat 5, rotation or shifting of a spindle 6 is prevented by a cooperation between a shaped surface 15 on a bearing flange 8*b* of a winding spindle-bearing sleeve 8 and a complementary surface of seat 5 (see FIG. 3).

Figure 2:
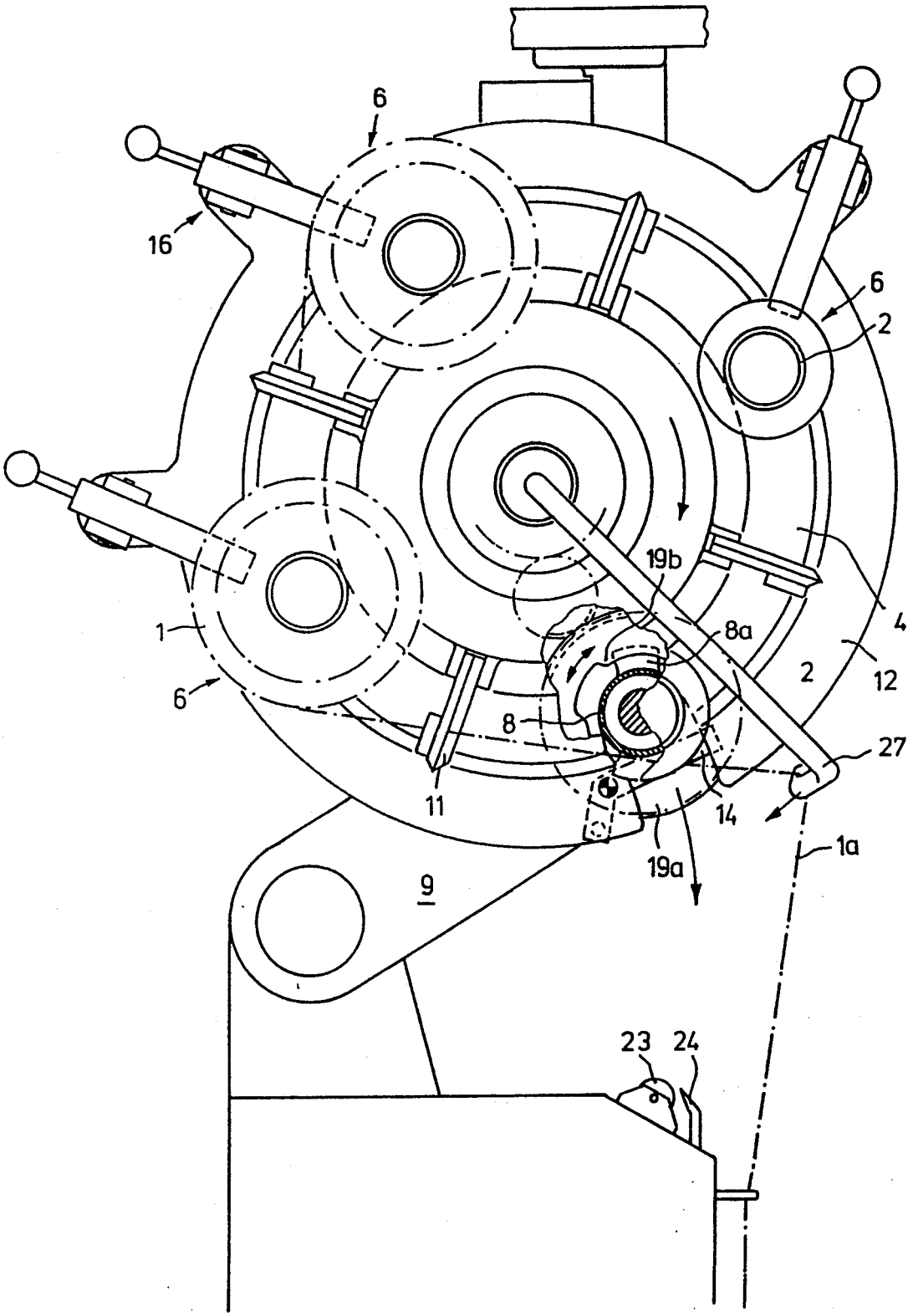
FIG. 2 is a view similar to FIG. 1, with the magazine partly broken away to reveal detail, which depicts the bobbin-winding unit in the position where it has received an empty bobbin.

When the transfer arm is swung to its upper position as shown in FIG. 2, presuming that there is no spindle coupled to the arm, the winding spindle to be engaged will be positioned coaxially with respect to the driven adaptor shaft 10. In order to prevent the interchangeable spindles 6 from falling from a seating 5 during a coupling or decoupling operation, a closing element 14 is located at the insertion aperture 13. The closing element 14 is operated by means, not shown in the drawing, and may be moved between the open position shown in FIG. 1 and the closed position shown in FIG. 2.

Manually operable release devices 16 are mounted on drum 12 at the index positions of each of the spindles seats 5 in rotatable plate 4. A release device 16, when operated, releases the engagement between a chuck 3 and a bobbin 2 thus allowing the removal of a fully wound bobbin and the insertion of an empty bobbin.

Returning again to a consideration of the rotatable winding spindle drive, the driven adaptor shaft 10 is rotatably coupled to the winding spindles 6 by means of a spline type connection 17. The establishment of this connection is accomplished by means of imparting axial movement to the drum 12 and rotatable plate 4. The drum and plate slide on support rods 20 (see FIG. 3) during this axial movement. The means which produces the axial movement of the drum and plate has been omitted from the drawing. As will be explained in more detail below, a coupling arrangement, indicated generally at 19, functions to axially capture the winding spindles 6 when the drive connection has been established between adaptor shaft 10 and spindle shaft 6*a*.

Figure 3:
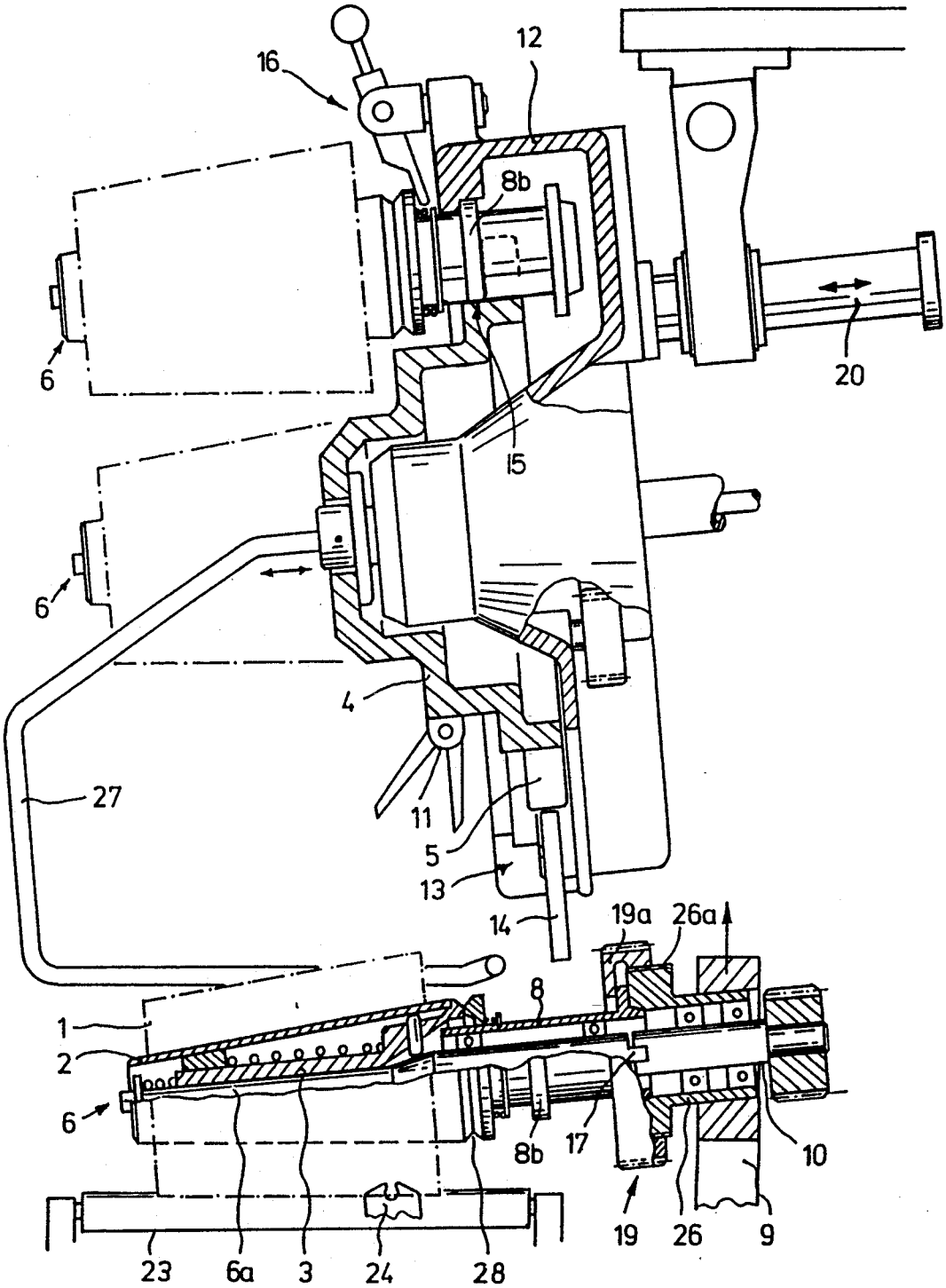
FIG. 3 is a side elevation view, partly in section, of the apparatus of FIGS. 1 and 2.

The operation of a bobbin change magazine in accordance with the present invention will now be described. In order to wind a sewing thread onto a bobbin 2, the transfer arm 9 will lower a winding spindle 6 with an associated bobbin onto the winding roller 23. The wound thread "package", indicated at 1 in the drawings, will be formed as a result of rotation of spindle 6 accompanied by axially oscillating movement of a thread guide 24. The spindle seating 5 from which the spindle/bobbin combination being wound has been taken is, during the winding operation, positioned above the bobbin being wound and the locking element 14 is in the open position. This arrangement is depicted in FIGS. 1 and 3. When the bobbin has been fully wound, the arm 9 will be caused to swing upwardly, about its pivot point, into the exchange position shown in FIG. 2. As the arm swings upwardly, the spindle 6 will move radially into the open seat 5 in plate 4. When moving into the seat 5, the spindle will pass through the insertion aperture 13 in the drum 12. Once the spindle is positioned in the seat 5, the closing element 14 will be swung to the closed position. As may be seen by simultaneous consideration of FIGS. 1 and 2, the movement of the spindle and the bobbin carried thereby from the winding position of FIG. 1 to the exchange position of FIG. 2 results in the sewing thread la being stretched substantially vertically.

The spindle-bearing flange is, after the spindle has been positioned in the seat 5 in rotatable plate 4, disconnected from the rotatable drive. This disconnection is accomplished by imparting a limited degree of rotation, by means not shown in the drawing, to a coupling member 19*a* which forms part of the coupling mechanism 19. Member 19*a* threadably engages a flange portion 26*a* of a bearing sleeve 26 which is mounted on arm 9 in coaxial relationship with the adaptor shaft 10. Thus, through the use of a motor drive, the coupling member 19*a* will be caused to rotate about portion 26*a* of sleeve 26 through a defined angle. This rotation, as may best be seen from FIG. 2, will permit a clamping flange 8*a* on the spindle-bearing sleeve 8 to be decoupled from flange 26*a* of bearing sleeve 26 by aligning flange 8*a* with a complementary shaped cut-out in flange 19*b* of coupling mechanism 19. Subsequently, as a result of the axial movement of the rotatable plate 4 with the drum 12, the winding-spindle shaft 6a is decoupled from the adaptor shaft 10, and the winding-spindle bearing sleeve 8 will move out of contact with the adaptor-shaft bearing sleeve 26. With the decoupling of the spindle from the rotary drive, the rotatable plate 4 is free to rotate and will be indexed to the next position. The full bobbin is, during indexing, retained in the spindle seat 5 as a result of the fact that the plate 4 rotates relative to drum 12 and thus the seat 5 in which the full bobbin is disposed will move out of registration with the insertion aperture 13.

During the rotation of plate 4, a thread hook 27 will swing from the position shown in FIG. 1 to that shown in FIG. 2 and, in so doing, will move from a position below and adjacent to the full bobbin in the direction of the empty bobbin which is being moved into position in registration with aperture 13. As the thread hook 27 moves to the FIG. 2 position, the thread 1a caused to move axially, as a result of sliding along hook 27, to a position where it is located behind the empty bobbin 2 in the vicinity of a clamping device 28. The clamping device 28 is defined by the bobbin chuck 3 and a washer which is caused to bear against the chuck by means of a spring. The thread hook 27 is caused to execute its swinging movement by means, not shown, which may include a link motion mechanism which superimposes the axial shifting movement of the thread on the rotational movement of the bobbin.

As the empty bobbin moves into position, i.e., into registration with the entrance aperture 13 in drum 12, it will engage the tightly stretched thread 1a extending between thread hook 27 and the bobbin 2 which has just been fully wound, i.e., the bobbin which is moving in a clockwise direction and departing the region of the entrance aperture 13. The relative movement between the "new" bobbin/spindle combination and the thread will cause the thread to be engaged by the clamping mechanism which will now hold the thread sufficiently tightly to permit the bobbin to be wound.

When the "new" bobbin/spindle combination reaches the FIG. 2 position where it is in registration with the entrance aperture 13, the rotatable plate 4 and drum 12 will be caused to move axially toward the adaptor shaft 10. The adaptor shaft 10 will be rotated at the same time and, accordingly, the spindle shaft 6a will be rotatably coupled to shaft 10 via the above-described mechanical connection 17. The axial movement of the plate 4 and drum 12 will also cause the spindle-bearing sleeve 8 to be pushed into the adaptor-shaft bearing flange 26. Subsequent energization of the rotatable drive for the coupling mechanism 19 will result in establishing the overlapping relationship between clamping surfaces 19b and 8a whereby the spindle sleeve 8, and thus the spindle/bobbin combination, will be secured against axial movement during subsequent rotation thereof.

As may be seen by FIG. 2, the thread 1a stretched between the previously wound bobbin and the thread-clamping device 28 on the "new" bobbin passes tauntly between the open cutting blades of one of a plurality of cutting and clamping devices 11 carried by plate 4. The clamping portion of each device 11 is positioned beside the cutting blades and on the side of the device which faces the wound bobbin. The cutting blades, which may be seen by FIG. 3, are spring biased to the closed position. The blades are opened by means of a cam arrangement wherein the cam follower, which functions as an actuating pin, slides from a cam ramp onto the end face of a pin which has been extended to the same level, the pin being retracted in accordance with a control program to deprive the follower/actuator of support. The closing of the cutting blades, to sever the thread 1a, follows the closing of the clamping device for the thread end which will be created when the thread is cut.

In order to start the winding of the "new" bobbin, the thread hook 27 is returned to its FIG. 1 starting position. The spindle coupled to the adaptor shaft 10 will be caused to rotate slowly and, as the thread hook 27 returns to its starting position, it will move the thread 1a into position where it will ultimately be captured by the thread guide 24. Oscillatory motion is imparted to the thread hook 27 as it moves from the FIG. 2 position to the FIG. 1 position by means of a cam arrangement not shown in the drawing. This oscillatory movement, in combination with the slow rotation of the spindle, will result in the leading end of the thread being captured on the bobbin by being spirally cross-wound on the bobbin.

The arm 9, with a winding spindle/bobbin combination coupled thereto, will now swing from the FIG. 2 position to the FIG. 1 position and thus the bobbin will be removed from its seat 5 in the rotary plate 4 and will be deposited on the winding roller 23. At the same time, the thread 1a will be intercepted by the oscillating thread guide 24 and the winding then speeds up to its normal operating rpm.

In order to remove the full bobbins from interchangeable spindles, the machine operator will, through use of the release devices 16, release the non-positive and/or positive mechanical connection between the bobbin and the spindle, i.e., the chuck 3 will be causes to open in the disclosed embodiment, and will pull the bobbin from the spindle. Empty bobbins can then be slipped onto the spindles. The winding head can operate while bobbins are being removed and installed.

Should faults occur on the spindle-changer, or should there be other reasons why automatic spindle-changing is not desired, the sequential operation of the changer can be terminated and the winding head then operated manually with one spindle kept continuously coupled to the adaptor shaft 10. The spindle magazine of the present invention can be installed on an existing bobbin-winding machine as a retrofit item, or can be installed only at some selected winding heads on an existing machine.

A particular advantage of the present invention resides in the fact that, in contrast to previously available automatic bobbin-winding machines, in the present invention all of the operations which must be performed by the machine operator may be accomplished from the front of the apparatus.

While a preferred embodiment has been shown and described, modifications and substitutions may be made hereto without departing from the spirit and scope of the invention. For example, as alternatives to the use of the discontinuous drum 12 to close the seats or pockets in the rotatable plate 4, it is possible to employ apparatus such as gripping tongs. Similarly, rather than employ a rotating plate with spindle receiving pockets, it is possible to utilize other rotatable components such as revolving turrets or rotary arms. Accordingly, it is to be understood that the present invention has been described by way of illustration and not limitation.

What is claimed is:

1. A bobbin exchange apparatus for a bobbin-winding machine comprising a plurality of spindle means, each of said spindle means including:

rotatable spindle shaft means;

means mounted on said spindle shaft means for radially connecting said shaft to a bobbin whereby said spindle shaft means and bobbin will rotate together; and means on an end of said spindle shaft means for permitting establishment of a rotatable drive connection thereto;

indexable magazine means, said magazine means having plural spaced spindle means receivers;

a spindle means transfer arm, said arm being moveable between a bobbin-winding position where a first end of said arm is located adjacent to a winding roller and a spindle means exchange position where said first end of said arm is located adjacent said magazine means;

rotary drive means mounted on said arm adjacent said first end thereof, said rotary drive means having a first end which cooperates with said means permitting establishment of a rotary drive connection;

coupling means mounted on said arm, said coupling means being operable to selectively establish and interrupt an axial connection between said rotary drive means and said spindle shaft means whereby said rotary drive means may be operatively connected to said means permitting establishment of a drive connection; and means for juxtapositioning said spindle means to said rotary drive means when said arm is in said exchange position whereby said coupling means may establish a connection between said spindle means and said rotary drive means and said arm means may thereafter move said spindle means to said bobbin-winding position.

2. The apparatus of claim 1 wherein said magazine means is a rotatable member having a plurality of evenly spaced spindle means receiving recesses in the outer periphery thereof, said magazine means being moveable in steps which correspond to the spacing between said recesses whereby said recesses may sequentially be advanced to a position adjacent said spindle means exchange position of said arm.

3. The apparatus of claim 2 wherein said rotatable member defines a cylinder and said recesses open radially outwardly with respect to said cylinder, and wherein said apparatus further comprises:

means for preventing said spindle means from moving radially out of said recesses except for the recess located at said spindle means exchange position.

4. The apparatus of claim 3 wherein said means for radially connecting said spindle means shaft means to a bobbin can be operated between bobbin engaging and bobbin release conditions and wherein said apparatus further comprises:

means for selectively operating said radial connecting means whereby bobbins may be removed from and installed on said spindle means in each of said spindle means receivers.

5. The apparatus of claim 4 wherein said rotary drive means comprises a rotatable adaptor shaft having a first end which operatively mates with said means for permitting establishment of a drive connection, wherein said magazine means rotates about an axis and wherein said juxtapositioning means imparts axial motion to said magazine means to move said spindle means axially toward and away from said adaptor shaft.

6. The apparatus of claim 4 wherein said coupling means includes a driven rotatable member which selectively establishes an interlocking relationship between said spindle means shaft means and said rotary drive means whereby relative axial motion between said spindle means shaft means and said rotary drive means may be selectively prevented.

7. The apparatus of claim 4 wherein said spindle means each further include:

a thread-clamping device.

8. The apparatus of claim 4 further including:

thread cutting and clamping means positioned on said magazine means intermediate said spindle means receiving recesses.

9. The apparatus of claim 4 further comprising:

an elongated thread hook, said thread hook being mounted for pivoting movement whereby a thread engaging portion thereof may be caused to swing between a position adjacent a said spindle means receiving recess located immediately downstream, in the direction of magazine means movement, from said spindle means exchange position and a position immediately upstream of said spindle means exchange position.

10. The apparatus of claim 3 wherein said rotary drive means comprises a rotatable adaptor shaft having a first end which operatively mates with said means for permitting establishment of a drive connection, wherein said magazine means rotates about an axis and wherein said juxtapositioning means imparts axial motion to said magazine means to move said spindle means axially toward and away from said adaptor shaft.

11. The apparatus of claim 3 wherein said coupling means includes a driven rotatable member which selectively establishes an interlocking relationship between said spindle means shaft means and said rotary drive means whereby relative axial motion between said spindle means shaft means and said rotary drive means may be selectively prevented.

12. The apparatus of claim 3 wherein said spindle means each further include:

a thread-clamping device.

13. The apparatus of claim 1 wherein said means for radially connecting said spindle means shaft means to a bobbin can be operated between bobbin engaging and bobbin release conditions and wherein said apparatus further comprises:

means for selectively operating said radial connecting means whereby bobbins may be removed from and installed on said spindle means in each of said spindle means receivers.

14. The apparatus of claim 1 wherein said magazine means at least in part includes a rotatable plate member, said plate member having a generally cylindrical shape, and wherein said spindle means receivers comprise recesses in the periphery of said plate member, said recesses opening generally radially outwardly.

15. The apparatus of claim 14 further comprising:

means for retaining said spindle means in said recesses in said rotatable plate member, said retaining means comprising a drum member which is coaxial with said plate member, said drum member being provided with an insertion aperture at said spindle means exchange position, said insertion aperture being sized to permit a spindle means to pass there-through as said arm moves between, its operating positions.

16. The apparatus of claim 1 wherein said rotary drive means comprises a rotatable adaptor shaft having a first end which operatively mates with said means for permitting establishment of a drive connection, wherein said magazine means rotates about an axis and wherein said juxtapositioning means imparts axial motion to said magazine means to move said spindle means axially toward and away from said adaptor shaft.

17. The apparatus of claim 1 wherein said coupling means includes a driven rotatable member which selectively establishes an interlocking relationship between said spindle means shaft means and said rotary drive means whereby relative axial motion between said spindle means shaft means and said rotary drive means may be selectively prevented.

18. The apparatus of claim 1 wherein said spindle means each further include:

a thread-clamping device.

19. The apparatus of claim 1 further including:

thread cutting and clamping means positioned on said magazine means intermediate said spindle means receivers.

20. The apparatus of claim 1 further comprising:

an elongated thread hook, said thread hook being mounted for pivoting movement whereby a thread engaging portion thereof may be caused to swing between a position adjacent a said spindle means receiver located immediately downstream, in the direction of magazine means movement, from said spindle means exchange position and a position immediately upstream of said spindle means exchange position.

* * * * *